United States Patent [19]

Kay et al.

[11] Patent Number: 4,857,280

[45] Date of Patent: Aug. 15, 1989

[54] METHOD FOR THE REGENERATION OF SULFIDED CERIUM OXIDE BACK TO A FORM THAT IS AGAIN CAPABLE OF REMOVING SULFUR FROM FLUID MATERIALS

[76] Inventors: D. Alan R. Kay, Burlington, Ontario, Canada; William G. Wilson, Pittsburgh Allegheny County, Pa.

[21] Appl. No.: 184,400

[22] Filed: Apr. 21, 1988

Related U.S. Application Data

[60] Continuation-in-part of Ser. No. 99,058, Sep. 21, 1987, Pat. No. 4,826,664, which is a continuation of Ser. No. 846,272, Mar. 31, 1986, Pat. No.

[51] Int. Cl.[4] ..... C01F 17/00

[52] U.S. Cl. ..... 423/21.1; 423/230; 423/244; 423/263

[58] Field of Search ..... 423/244 A, 244 R, 21.1, 423/230, 263

[56] References Cited

U.S. PATENT DOCUMENTS

| | | | |
|---|---|---|---|
| 1,912,455 | 6/1933 | Ingraham . | |
| 3,211,549 | 11/1965 | Kusaka | 75/134 |
| 3,784,374 | 1/1974 | Almand | 75/129 |
| 3,795,505 | 3/1974 | Corradini | 75/53 |
| 3,816,103 | 6/1974 | Link | 75/53 |
| 3,818,869 | 6/1974 | Blaskowski | 122/5 |
| 3,909,212 | 9/1975 | Schroeder | 44/1 R |
| 3,974,256 | 8/1976 | Wheelock | 423/230 |
| 4,001,375 | 1/1977 | Longo | 423/244 |
| 4,018,597 | 4/1977 | Staggers | 75/58 |
| 4,286,973 | 9/1981 | Hamlin | 55/92 |
| 4,290,805 | 9/1981 | Gorgerino | 75/120 R |
| 4,311,683 | 1/1982 | Hass et al. | 423/230 |
| 4,313,758 | 2/1982 | Henning | 75/130 R |
| 4,346,063 | 8/1982 | Cahn | 423/230 |
| 4,399,112 | 8/1983 | Vorin | 423/230 |

OTHER PUBLICATIONS

Philip S. Lowell et al., "Selection of Metal Oxides for Removing $SO_2$ from Flue Gas", Ind. Eng. Chem. Process Des. Develop., vol. 10, No. 3, 1971.

*Primary Examiner*—Gregory A. Heller

*Attorney, Agent, or Firm*—Buchanan Ingersoll; Michael L. Dever

[57] ABSTRACT

A method for the regeneration of sulfur containing cerium compounds formed by the desulfurization of fluid materials containing sulfur with cerium oxide back to its original form, $CeO_2$, wherein the sulfur containing cerium compounds are removed from contact with the fluid material containing sulfur; the temperature of the sulfur containing cerium compounds is raised above the temperature at which cerium sulfate dissociates; and the sulfur containing cerium compounds whose temperature is above the temperature at which cerium sulfate dissociates is exposed to an oxidizing atmosphere.

19 Claims, No Drawings

METHOD FOR THE REGENERATION OF SULFIDED CERIUM OXIDE BACK TO A FORM THAT IS AGAIN CAPABLE OF REMOVING SULFUR FROM FLUID MATERIALS

This application is a continuation-in part of our co-pending application Ser. No. 099,058, now U.S. Pat. No. 4,826,664 which is a continuation of our co-pending application Ser. No. 846,272 filed Mar. 31, 1986, which was a division of application Ser. No. 718,989, filed Apr. 2, 1985, now U.S. Pat. No. 4,604,268, which was a continuation-in-part of our application Ser. No. 471,773 filed Mar. 3, 1983, now abandoned which was a continuation of our application Ser. No. 174,024 filed July 31, 1980 now U.S. Pat. No. 4,397,683.

This invention relates to the method for the regeneration of sulfided cerium oxide back to a form that can again react with fluid materials containing sulfur so that the cerium oxide is again capable of reacting with fluid materials containing sulfur.

The phrase "fluid materials" will be used hereinafter to describe fluids such as molten iron and steel, gases resulting from the incomplete combustion of sulfur containing hydrocarbons which are commonly referred to as "fuel gases" and gases resulting from the complete combustion of sulfur containing hydrocarbons which are commonly referred to as "flue gases" and the like.

Cerium is one of the lanthanide group of elements that are commonly referred to as "rare earth" elements having atomic numbers from 57 to 71, inclusive, and the element yttrium, atomic number 39, which is often found in rare earth concentrates and acts similarly to the other lanthanides in many respects.

According to the ENERGY HANDBOOK published by Van Nordstrom and Reinhold, there are 36.5 Quads (one Quad $=10^{18}$ Btu) of energy in the coal reserves of the United States as compared to 1.4 Quads in oil and 1.1 Quads in natural gas. Most of these coal reserves have sulfur contents that require some form of desulfurization of the stack gases from the boilers of new power plants generating electricity to meet current standards of the Environmental Protection Agency (EPA) of the U.S. Government. For the newest most efficient methods for the generation of electric power, such as Integrated Gasifier combined cycle (IGCC) power plants and fuel cells much lower sulfur contents are required for their fuels to insure their efficient operation than is required by the EPA for ecological reasons. The United States Department of Energy (DOE) has taken the lead in the development of methods to utilize this energy in coal for the generation of electric power in an ecologically and economically acceptable manner. The DOE has taken the initiative in these matters because the electric power generation industry and its suppliers has been reluctant to pursue this task, and an agency of the U.S. Government has been forced to take the lead just as was the case in the development of synthetic rubber and nuclear power generation.

There is further necessity to develop methods for the utilization of coal because of the political instability in the Persian Gulf which is a major source of much of the world's oil, and the wide fluctuations in the price of crude oil in the last few years are clearly indicative of this instability.

Evidence continues to mount with regard to the detrimental effect of acid rain. Most of the effort to reduce the emission of sulfur from presently operating power plants using steam turbines for the generation of electricity have been concentrated on the removal of sulfur dioxide from the flue gases after the complete combustion of the sulfur containing hydrocarbon with burnt lime or limestone added either into wet scrubbers or injected as slurries or dry powders into the duct work of the boilers between the air preheaters and the electrostatic precipitators.

At the Seventh Annual Gasification and Gas Stream Cleanup Systems Contractors Review Meeting sponsored by the Morgantown Energy Technical Center of the DOE held in June 1987 many of the requirements for coal-derived fuel gases for gas turbines, fuel cells and the production of liquid fuels for the transportation industry produced from coal were described. Dr. James Corman, Manager of Thermochemical Processes Branch, General Electric Corp., stated that fuel gases for combined cycle gas turbines should contain less than 100 parts per million (ppm) of hydrogen sulfide ($H_2S$), have a Btu value of at least 150 Btu from an air blown gasifier, and have as high a hydrogen content as possible to permit flame stability at low temperatures.

Specifications for fuel gases derived from the partial combustion of sulfur containing hydrocarbons for fuel cells are more restrictive, requiring that the gases contain $H_2S$ contents no greater than 2 to 3 ppm.

The catalyst used for the production of methanol from fuel gases derived from the partial combustion of sulfur containing hydrocarbons are very sensitive to sulfur. In a program sponsored by DOE, Mountain Fuel Resources has utilized a catalyst for the conversion of fuel gases to methanol that was less sensitive to sulfur than those previous used. However, the exact level of sulfur that can be tolerated was not reported in the brief announcement available. It is likely that the lower the sulfur content of the fuel gases being used for the production of methanol, the better the process will perform over long periods of time. However, even if the catalyst can operate with high sulfur fuel gases, there will have to be some method developed to capture the sulfur in the fuel gas rather than having that sulfur released into the atmosphere.

The application of cerium oxide for the desulfurization of fluid materials such as molten iron and steel has not been exploited because other methods appear to be more economical.

A term commonly used by chemical engineers to describe materials that react with the sulfur in fluid materials is the word "sorbent", which appears to be an encompassing term that includes all of the methods whereby two materials become one. The methods whereby two materials become one include: (1) chemical reaction between the two materials; (2) absorption of one material in another like water into a sponge, and (3) adsorption which is the attachment of a thin layer of one material on the other. This ill-defined term "sorbent" will be used hereafter to describe the cerium oxide used for the desulfurization of sulfur containing fluid materials, but for this application the definition is related to, (1), the chemical reaction of the cerium oxide and the sulfur in the fluid materials.

For all of the applications of cerium oxide for the desulfurization of fluid materials, it is essential that a method be developed for the regeneration of the sulfided cerium oxide to reduce the cost of the desulfurization process. Although the application of cerium oxide for the desulfurization of iron and steel has not been utilized, development of an economical means to regenerate the sulfided cerium oxide back to cerium oxide which is again capable of removing sulfur from iron and steel could improve the economics of the process to such an extent that its application for such fluid materials would be economically feasible.

Cerium oxide is most commonly found in nature in the ceric form or $CeO_2$. Cerium oxide is most effective as a desulfurizer of fuel gases when it has been reduced by exposure to a reducing gas such as hydrogen to a composition between the ceric ($CeO_2$) and cerous ($Ce_2O_3$) forms of the oxide which can be expressed as $CeO_{(2-x)}$ according to the following reaction:

$$CeO_2\,(s)+xH_2\,(g)=CeO_{(2-x)}\,(s)+xH_2O\,(g) \quad (1)$$

When $CeO_{(2-x)}$ is exposed to a fuel gas containing $H_2S$ the reaction for the removal of the $H_2S$ from the gas may be written as follows:

$$2CeO_{(2-x)}\,(s)+H_2S\,(g)=Ce_2O_2S\,(s)+2(1-2\,x)H_2O\,(g) \quad (2)$$

This invention relates to the method for the regeneration of $Ce_2O_2S$ back to its original form, $CeO_2$, with an oxidizing atmosphere. This procedure wa developed using a column of cerium oxide six centimeters high and one centimeter in diameter, (the reactor) during the work performed under Small Business Innovation Research (SBIR) Phase I contract with the Department of Energy (DOE), DE-ACO1-86ER80347. Equations (3) and (4), which describe the reactions that occur when the sulfided sorbent is exposed to an oxidizing atmosphere containing oxygen follow:

$$Ce_2O_2S\,(s)+3/2O_2\,(g)=CeO_2\,(s)+SO_2\,(g) \quad (3)$$

Equation (3) does not express all the reactions that take place during regeneration. There is a reaction between some of the $SO_2$ and $CeO_2$ resulting from the regeneration of the $Ce_2O_2S$ with an oxidizing atmosphere resulting in the formation of a sulfate of cerium [$Ce_2(SO_4)_3$] that can be expressed as follows:

$$2CeO_2\,(s)+3SO_2\,(g)+O_2\,(g)=Ce_2(SO_4)_3\,(s) \quad (4)$$

Equation (4) may also be used to describe the reaction between a fluid material such as a flue gas and cerium oxide.

The objective of regeneration was stated to be to convert the sulfided cerium oxide to a form that was again capable of removing sulfur from fluid materials. It has been determined by thermodynamic calculations and experimental evidence that $Ce2(SO_4)_3$ is capable of reacting with the sulfur in gases.

This invention further relates to the method for the elimintion of $Ce_2(SO_4)_3$ whereby the necessity for exposure to a reducing gas such as $H_2$ according to reactions (5), (6) and (7) which follow is minimized:

$$Ce_2(SO_4)_3(s)+2(1-x)H_2(g)=2CeO_{(2-x)}(s)+3SO_2(g)+2(1+x)H_2O(g). \quad (5)$$

or $$Ce_2(SO_4)_3\,(s)+6H_2\,(g)=Ce_2O_2S\,(s)+2SO_2\,(g)+6H_2O(g) \quad (6)$$

The $Ce_2O_2S$ and $H_2O$ produced by reactions (5) and (6) react further to form $H_2S$ according to the following equation:

$$Ce_2O_2S(s)+2(1-x)H_2O(g)=2CeO_{(2-x)}(s)+H_2S(g)+(1-2x)H_2(g) \quad (7)$$

EXAMPLE I

The work performed by Meng in partial fulfillment of the requirements for a doctorate degree at McMaster University in Hamilton, Ontario illustrates the importance of the temperature at which the oxidizing portion of the regeneration of the $Ce_2O_2S$ is conducted. This work, which was presented in a doctorate thesis entitled HIGH TEMPERATURE GASEOUS DESULFURIZATION USING CERIUM OXIDES AND BASTNASITE CONCENTRATES, shows that when the oxidizing stage of the regeneration is conducted at 872° C./1572° F. with air that the $SO_2$ content of the gases exiting the reaction chamber containing the sorbent exceed 6600 ppm within two minutes of the introduction of the air. Within ten minutes the $SO_2$ content of the gas exiting the reaction chamber is less than 10 ppm of $SO_2$.

Data from Meng also confirms that reactions (5) and (6) do occur. After exposure to the air the partially regenerated cerium oxide sorbent was exposed to a gas containing 5% hydrogen and the remainder nitrogen The Meng data shows that there was a release of $SO_2$ whose peak value was approximately 666 ppm of $SO_2$ and the $SO_2$ content of the reducing gas contained approximately 66 ppm of $SO_2$ after fifty minutes of exposure to the reducing gas. During the same period the $H_2S$ content of the gases was as high as 66 ppm and was at approximately the 33 ppm level after fifty minutes. Furthermore, Meng reported no release of elemental sulfur during the regeneration process.

The regeneration procedure used by Meng has the following disadvantages:

1. Incomplete regeneration with air;
2. Consumption of expensive reducing gases to complete the regeneration;
3. No production of elemental sulfur.

This invention further relates to the method for the elimination of $Ce_2(SO_4)_3$ whereby $Ce_2(SO_4)_3$ is raised to a temperature greater than 900° C./1652° F. but less than 1250° C./2282° F. whereby the $Ce_2(SO_4)_3$ dissociates by the reversal of reaction (4) as follows:

$$Ce_2(SO_4)_3\,(s)=2CeO_2\,(s)+3SO_2\,(g)+O_2(g) \quad (8)$$

All of the other major members of the lanthanide group of elements (lanthanum, neodymium, praseodymium and samarium) form sulfates, however, an example of a typical form of sulfate formed from these lanthanides would be the sulfate of lanthanum which Would have the composition expressed by the formula $La_2O_2SO_4$. Thermodynamic calculations show that the decomposition temperature of these sulfates at one atmosphere pressure, similar to the decomposition of $Ce_2(SO_4)_3$ shown in equation (8), range from 1525° C./2747° F. to 1670° C./3008° F. Therefore, the most likely method for converting these sulfates back to their oxides is with a reducing gas according to reactions that would be similar to those shown in equations (5), (6), and (7).

This invention further relates to the method whereby the amount of oxygen in the oxidizing atmosphere used for the regeneration of the $Ce_2O_2S$ is limited to promote the formation of elemental sulfur during the regeneration process according to the following reaction:

$$Ce_2O_2S\ (s)+O_2\ (g)=CeO_2\ (s)+\tfrac{1}{2}S_2\ (g) \quad (9)$$

It has been stated that oxygen reduced regeneration is thermodynamically equivalent to regeneration with $SO_2$.

This invention further relates to the method whereby the oxidizing atmosphere used for the regeneration of sulfided cerium oxide contains less than 5% oxygen to prevent the sorbent from attaining a temperature greater than the sintering temperature used during the manufacture of the pellets or granules thereby retaining most of the porosity generated in the pellets or granules during their manufacture. $AG^0$ at any temperature can be computed for reaction (9) from the following equation:

$$AG^0=-109090+33.9TkJ \quad (10)$$

Equation (10) shows that reaction (9) is very exothermic which would increase the temperature in the sorbent very quickly. If the temperature attained during regeneration is not to exceed the sintering temperature of the pellets or granules during manufacture, the oxygen content of the regenerating gases must be limited.

EXAMPLE II

During the manufacture of one set of granules, the granules were pyrolyzed at 300° C. BET Surface Area Was 21.6 $m^2$/gm and pore volume was reported to be very high. When these same granules were sintered at 1250° C. to increase their strength after the pyrolysis step their BET Surface Area was reduced to 2.8 $m^2$/gm and their pore volume was reduced to 1.3 $cm^3$/gram. Therefore it is important that the maximum temperature reached during regeneration not exceed the sintering temperature of the granules to prevent further loss of surface area and pore volume to retain maximum utilization of the sorbent during sulfidation. Applying the teachings of this invention, utilization of the sorbent (amount of the sorbent converted to $Ce_2O_2S$) was as high as 17 g. In previous experiments on the use of cerium oxide for the desulfurization of fuel gases the utilization was less than 0.5%.

A drawing which illustrates the various changes that occur follows:

FIG. 1 is a plot of Three Successive Desulfurization Runs with Sorbent #7 at 800° C. with $CO/CO_2=6$,

EXAMPLE III

The benefits of the teachings of this invention can be illustrated by comparing the extent of the desulfurization of three successive sulfidation-regeneration experiments with a simulated fuel gas containing 1% $H_2S$ (10000 ppm), 33% $H_2$, 55.4% CO and 10.6% $CO_2$. These experiments were run at a temperature of 800° C./1472° F., and the data from these runs is plotted in FIG. 1. Two levels of desulfurization are achieved. During the first fifteen minutes of these runs the gases exiting the reactor in which the experiments are conducted contain less than 50 ppm of $H_2S$ which represents 99.5% removal of the hydrogen sulfide. This $H_2S$ removal to these low levels has been designated the primary desulfurization. After primary desulfurization, there is a period of about forty minutes (from 20 minutes after the beginning of the run to sixty minutes after the run commenced) when there is $H_2S$ removal from the gas to about the 1500 ppm level at 20 minutes and to about 3000 ppm of $H_2S$ at 60 minutes. This represents secondary sulfur removal of 70% and 85% for all three runs. The significance of this data is not in the extent of the desulfurization, but in the consistency of these three runs which indicate that the sorbent that has been regenerated after the first and second runs is capable of almost the same degree of desulfurization as the sorbent was able to achieve during the first run.

The regeneration of the sorbent in these experiments was performed using the teachings of this invention. The procedure was as follows:

1. The desulfurization runs were made at 800° C./1372° F.;
2. At the completion of the desulfurization runs, the temperature in the reactor was raised to 920° C./1688° F.;
3. A mixture of 20% air, remainder nitrogen was admitted to the reactor;
4. In six to seven minutes after the mixture of air and nitrogen was admitted in the reactor in both tests, elemental sulfur was apparent at the top of the reactor tube;
5. After a total of 33 to 38 minutes after the air-nitrogen mixture was admitted to the reactor, no more sulfur was observed exiting the reactor;
6. For an additional period of 12 to 15 minutes, air was admitted to the reactor that was not mixed with additional nitrogen to complete the removal of the sulfur from the sorbent.

The consistency of the results from the three successive sulfidation-regeneration run made using the teachings of this invention for the regeneration of the sulfided sorbent attest to the merits of the invention.

Various embodiments and modifications of this invention have been described in the foregoing description and examples, and further modifications will be apparent to those skilled in the art. Such modifications are included within the scope of the invention as defined by the following claims.

We claim:

1. A method for the regeneration of sulfur-containing cerium compounds formed by the desulfurization of fluid materials containing sulfur with cerium oxide back to its original form, $CeO_2$, comprising the steps of:

(a) Removing the sulfur-containing cerium compounds from contact with the fluid material containing sulfur;

(b) Raising the temperature of the sulfur-containing cerium compounds above the temperature at which cerium sulfate dissociates; and (c) Exposing the sulfur-containing cerium compounds whose temperature is above the temperature at which cerium sulfate dissociates to an oxidizing atmosphere.

2. The method as claimed in claim 1 wherein the sulfur-containing cerium compound being regenerated is cerium oxysulfide ($Ce_2O_2S$).

3. The method as claimed in claim 1 wherein the fluid material being desulfurized is a fuel gas resulting from the incomplete combustion of a sulfur-containing hydrocarbon.

4. The method as claimed in claim 1 wherein the fluid material being desulfurized is a flue gas resulting from the incomplete combustion of a sulfur-containing hydrocarbon.

5. The method as claimed in claim 1 wherein the fluid material being desulfurized is iron or steel.

6. The method as claimed in claim 1 wherein the temperature of regeneration is greater than 872° C. (1572° F.) and less than 2500° C. (4502° F.), the reported melting point of some forms of cerium oxide.

7. The method as claimed in claim 6 wherein the temperature of regeneration is between 900° C. (1652° F.) and 1400° C. (2552° F.), at Which temperature there would be a significant reduction in the porosity of the pellets or granules of cerium oxide.

8. The method as claimed in claim 6 wherein the temperature of regeneration is between the temperature of 920° C. (1688° F.) and 1250° C. (2282° F.), at which temperature there should be essentially complete dissociation of the $Ce_2(SO_4)_3$ and a significant amount of porosity retained in the sorbent.

9. The method as claimed in claim 1 wherein the oxidizing atmosphere used for regeneration utilizes a mixture of oxygen and an inert gas as the oxidizing agent.

10. The method as claimed in claim 9 wherein the inert gas is nitrogen.

11. The method as claimed in claim 1 wherein the oxidizing atmosphere used for regeneration contains water as an oxidizing agent.

12. The method as claimed in claim 1 wherein the oxidizing atmosphere used for regeneration contains oxygen, water and an inert gas.

13. The method as claimed in claim 12 wherein the inert gas is nitrogen.

14. The method of claim 1 wherein the oxygen content of the oxidizing atmosphere used for regeneration is limited to an amount no greater than that which would limit the temperature attained during the regeneration to that of the sintering temperature of said cerium compounds.

15. The method as claimed in claim 1 wherein the oxygen content of the oxidizing atmosphere used for regeneration is limited to promote the formation of elemental sulfur according to the reaction:

$$Ce_2O_2S\ (s)+O_2\ (g)=CeO_2\ (s)+\tfrac{1}{2}S_2\ (g)$$

16. The method as claimed in claim 1 wherein the oxygen content of the oxidizing atmosphere used for regeneration contains less than 4% by volume of oxygen resulting in the formation of elemental sulfur as one of the gases occurring during the regeneration process.

17. The method as claimed in claim 1 wherein the oxygen content of the oxidizing atmosphere used for the regeneration contains less than 4% by volume of oxygen as a means of limiting the increase in temperature due to the exothermic reaction between the oxygen and the sulfided cerium oxide to prevent the temperature in the reactor from exceeding the temperature at which the pellets or granules are sintered to insure sufficient strength to prevent attrition during successive cycles of sulfidation and regeneration of the sorbent while retaining a significant amount of porosity to improve the utilization of the cerium oxide sorbent.

18. The method as claimed in claim 1 wherein the temperature of regeneration is greater than 900° C. (1652° F.) so that the amount of hydrogen necessary to eliminate any $Ce_2(SO_4)_3$ remaining after the oxidation of the sulfided sorbent is minimized.

19. The method as claimed in claim 18 wherein the temperature of regeneration is greater than 920° C. (1688° F.) and less than 1250° C. (2282° F.).

* * * * *

UNITED STATES PATENT AND TRADEMARK OFFICE

CERTIFICATE OF CORRECTION

PATENT NO. : 4,857,280

DATED : August 15, 1989

INVENTOR(S) : D. Alan R. Kay, et al.

It is certified that error appears in the above-identified patent and that said Letters Patent is hereby corrected as shown below:

Column 3, line 25, change "wa" to --was--.

Column 3, line 55, change "Ce2$(SO_4)_3$" to --$Ce_2(SO_4)_3$--.

Column 3, line 55, change "capable" to --incapable--.

Column 4, line 58, change "Would" to --would--.

Column 7, line 11, Claim 7, change "Which" to --which--.

Signed and Sealed this

Fourteenth Day of August, 1990

*Attest:*

HARRY F. MANBECK, JR.

*Attesting Officer*

*Commissioner of Patents and Trademarks*